United States Patent [19]

Day et al.

[11] 4,392,038

[45] Jul. 5, 1983

[54] SELF-CLEANING MICROWAVE CONVECTION OVEN

[75] Inventors: William J. Day, Allentown; Bernard J. Weiss, Borto, both of Pa.

[73] Assignee: Raytheon Company, Lexington, Mass.

[21] Appl. No.: 208,229

[22] Filed: Nov. 10, 1980

Related U.S. Application Data

[63] Continuation of Ser. No. 4,008, Jan. 16, 1979, abandoned.

[51] Int. Cl.[3] ..... H05B 6/64

[52] U.S. Cl. ..... 219/10.55 D; 219/10.55 R; 219/400; 126/21 A; 431/335

[58] Field of Search ..... 219/10.55 F, 10.55 D, 219/10.55 R, 10.55 E, 10.55 A, 400, 396; 126/21 A, 21 R, 39 G, 39 E; 431/335, 300, 354; 239/554, 555; 36/1

[56] References Cited

U.S. PATENT DOCUMENTS

| | | | |
|---|---|---|---|
| 2,443,101 | 6/1948 | Flynn et al. | 239/555 X |
| 2,494,243 | 1/1950 | Houlis | 431/354 X |
| 2,910,566 | 10/1959 | Smith | 219/10.55 F |
| 3,307,612 | 3/1967 | Stack | 239/555 X |
| 3,854,219 | 12/1974 | Staats | 34/1 |
| 3,884,213 | 5/1975 | Smith | 219/400 X |
| 3,926,106 | 12/1975 | Deusing et al. | 99/447 |

FOREIGN PATENT DOCUMENTS

| | | | |
|---|---|---|---|
| 2757710 | 6/1978 | Fed. Rep. of Germany | 219/10.55 F |
| 52-13150 | 1/1977 | Japan | 219/10.55 R |
| 1220596 | 1/1971 | United Kingdom | 239/555 |

*Primary Examiner*—B. A. Reynolds
*Assistant Examiner*—Philip H. Leung
*Attorney, Agent, or Firm*—William R. Clark; Joseph D. Pannone; Herbert W. Arnold

[57] ABSTRACT

A microwave convection oven in which a gas burner positioned outside the oven cavity has its combustion products circulated through the oven through screens for preventing escape of the microwave energy from the oven cavity with the burner being of the multi-ported type providing high burner density and having secondary air closely adjacent all portions of the burner to reduce its incondescent flame length while permitting the burner to be positioned in a region between the screened vapor outlet region the oven and the inlet of a blower system for mixing the output of the burner with the vapor drawn from the oven thus the temperature of the vapor outlet region is maintained below that at which ionization of the vapor being drawn from the oven might produce leakage of microwave energy through the screen.

2 Claims, 5 Drawing Figures

SELF-CLEANING MICROWAVE CONVECTION OVEN

CROSS REFERENCE TO RELATED CASES

This is a continuation of application Ser. No. 4,008 filed Jan. 16, 1979, now abandoned.

CROSS-REFERENCE TO RELATED APPLICATIONS

Copending U.S. patent application Ser. No. 962,342, filed Nov. 20, 1978, now abandoned, and assigned to the same assignee as the present invention, is hereby incorporated by reference and made a part of this disclosure.

BACKGROUND OF THE INVENTION

In the aforementioned copending application there is shown a convection oven in which combustion products from a gas burner may be circulated through an oven by mixing said combustion products with vapor drawn out of the oven into the inlets of a circulating fan system. As the capacity of the burner is increased, the flame length of such a burner increases to a point where combustion is not completed before the flame enters the region between the inlet of the blower and the screened outlet of the oven. The vapor can thus become ionized and can act as a partial conductor at the screened region outlet which can permit microwave energy to be emitted from the interior of the oven into the region of the burner blower. This can result in absorption of the microwave energy and hence reduction of microwave energy cooking power in the oven, and can allow the microwave energy to leak through the burner and/or blower structure out into the room.

SUMMARY OF THE INVENTION

This invention provides a combination microwave and convection heating system in which a multi-port gas burner is positioned adjacent an apertured vapor outlet region of an enclosure energized with microwave energy with burner flame height being restricted by excess secondary air near each burner port being drawn into a combustion plenum by a system for the circulation of vapor through the enclosure. More specifically, the burner comprises a plurality of metal ribbons which are transversely corrugated along their length so that the corrugations act as ports. Preferably, the ribbons have a width, extending from plenums supplied with the primary fuel-air mixture to the combustion plenum, which is sufficient to prevent flashback into the supply plenum even when relatively high primary fuel-air mixtures such as 50–80% are used. In addition, by having each of the ports separated from a secondary air source by less than three intervening ports and by using excess air on the order of between 50 and 150% the height of the flame may be substantially reduced so that for burner densities of greater than 1000 BTUs/hr for each square inch of burner surface, a flame height of less than an inch can be achieved. Thus, the combustion products can be mixed with vapor drawn from the enclosure in the region of the apertured outlet region without microwave energy in the enclosure leaking through the apertures.

Preferably the burner is run by using the negative pressure created by the inlet of a blower to draw the primary fuel-air mixture through the burner at a rate which lifts the burner flame from the surface of the burner ports so that heating of the burner port region is reduced thereby reducing probability of flashback through the burner ports.

This invention further provides that by the use of a blower for drawing the combustion products from the burner out of the combustion plenum which is adjacent to both the blower system input and the vapor outlet of an enclosure supplied by microwave energy, a combustion burner system may be achieved which allows the major portion of the bottom of the oven to be used for the generation and feed of microwave energy to the oven.

Further in accordance with this invention there is provided a dual control system for a combination convection and microwave heating system wherein a temperature probe is used to sense the temperature of a food body and a second temperature sensor is provided to sense the temperature of heated vapor being circulated through the oven. More specifically, the temperature probe may be used to indicate when the temperature of the food body reaches a predetermined temperature and a signal from the probe may be used to turn the microwave energy on and off to maintain the food body temperature as sensed by the probe at or above a temperature which may be preselected by a manual temperature selector. Simultaneously or alternatively the temperature of vapor being circulated through the oven from a source of heat such as a gas burner positioned outside the oven enclosure may be sensed and this temperature used to turn the gas burner on and off to maintain the vapor in the enclosure at a temperature selected by a manual temperature selection control.

Preferably, the temperature probe is connected to the wall of the oven enclosure by a conventional cable such as a flexible coaxial line connected between the temperature probe and a jack which is insertable into a plug in the wall of the oven. The temperature probe is thereby removable from the oven so that the flexible cable and temperature probe may be fabricated of materials which need only withstand the convention oven vapor temperature during normal cooking and may be removed from the oven when elevated temperatures of up to 1,000° F. are circulated through the oven for self-cleaning purposes.

BRIEF DESCRIPTION OF THE DRAWINGS

Other and further embodiments of the invention will become apparent as the description thereof progresses, reference being had to the accompanying drawings wherein.

DESCRIPTION OF THE PREFERRED EMBODIMENT

Figures 1, 2:
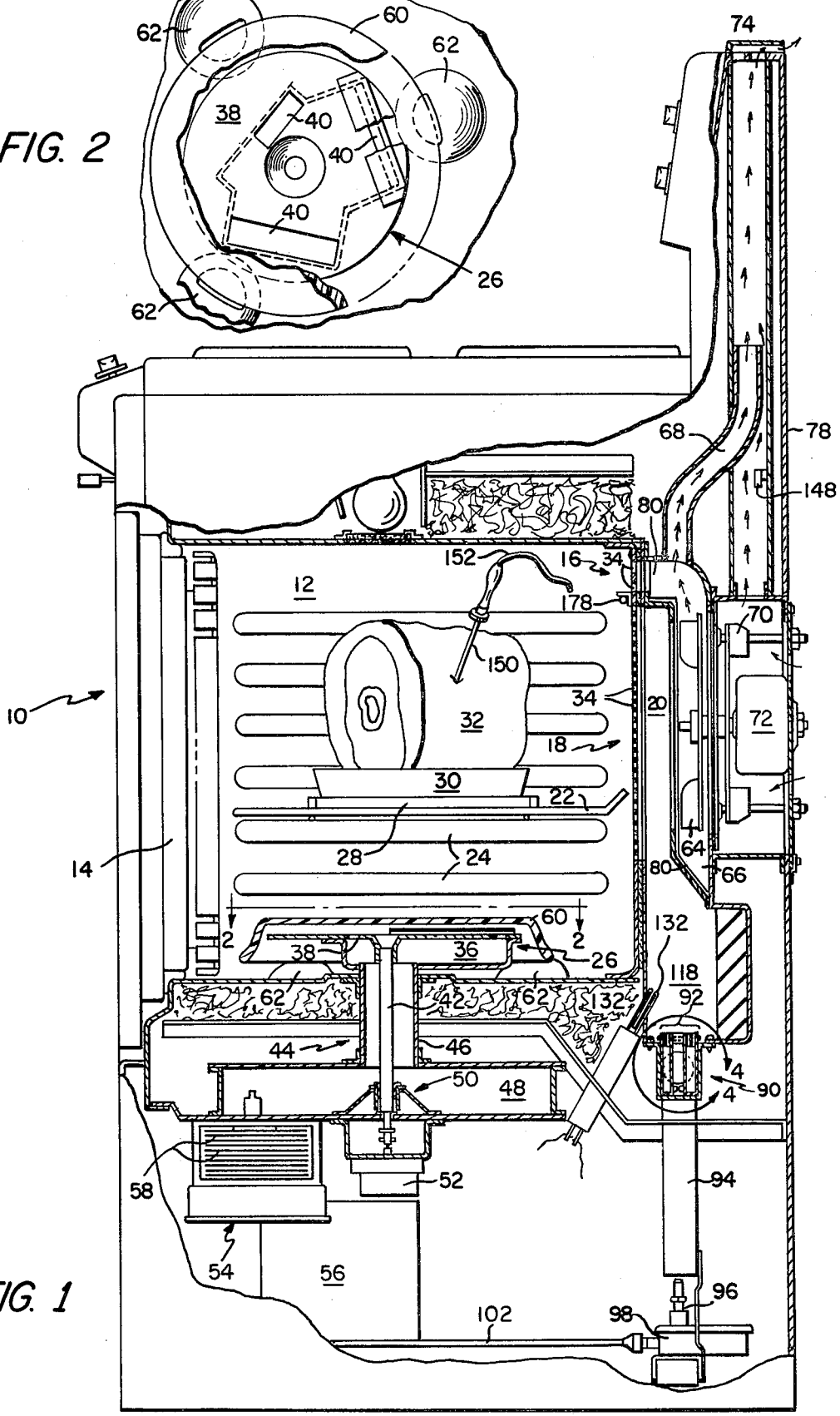
FIG. 1 illustrates a partially broken away side elevation view of an oven embodying the invention.
FIG. 2 illustrates a partial sectional view of a detail of the oven of FIG. 1 taken along line 2—2 of FIG. 1.
Figure 3:
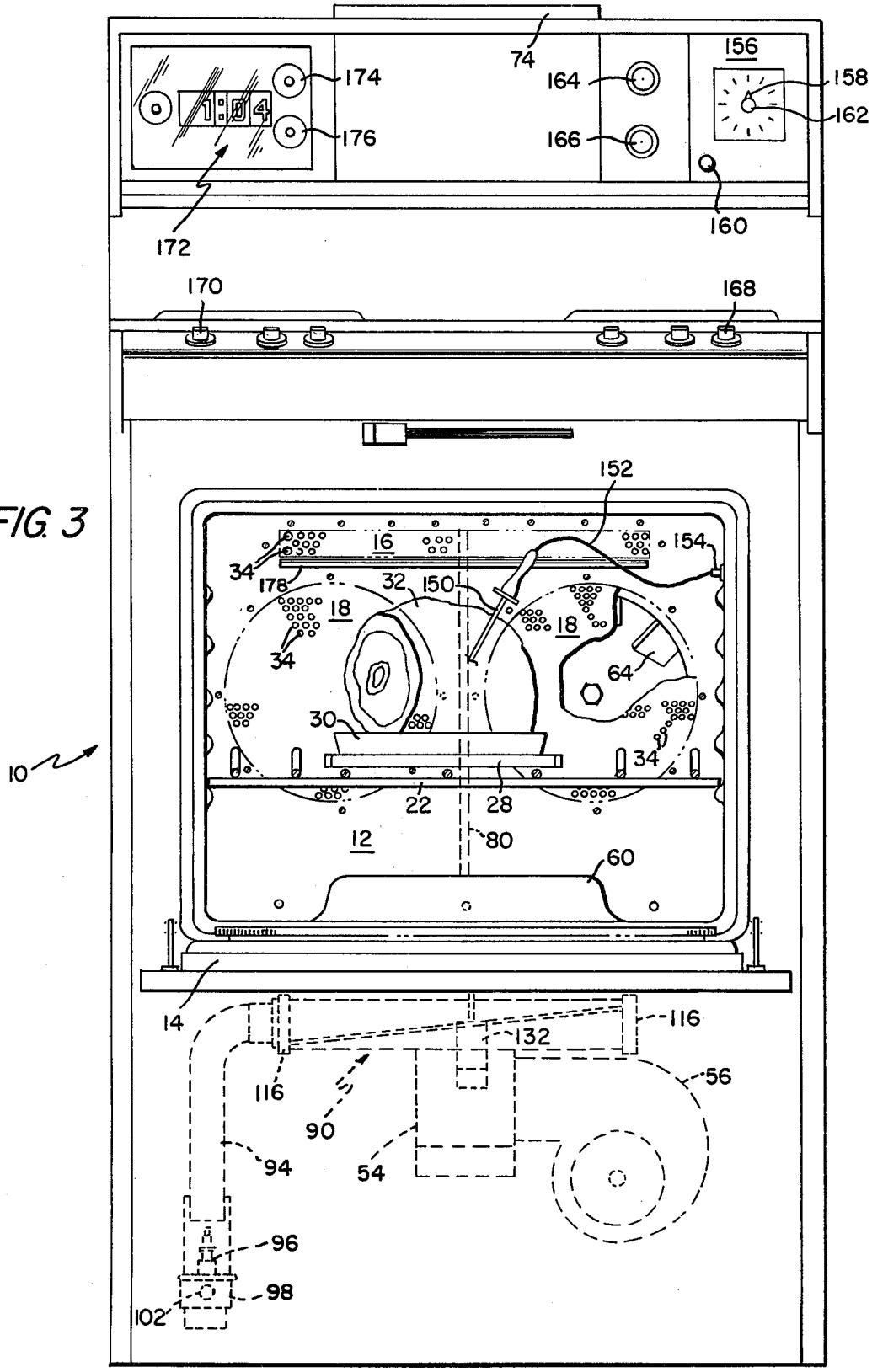
FIG. 3 illustrates a vertical elevation view of the oven of FIG. 1 taken along line 3—3 of FIG. 1.
Figure 4:
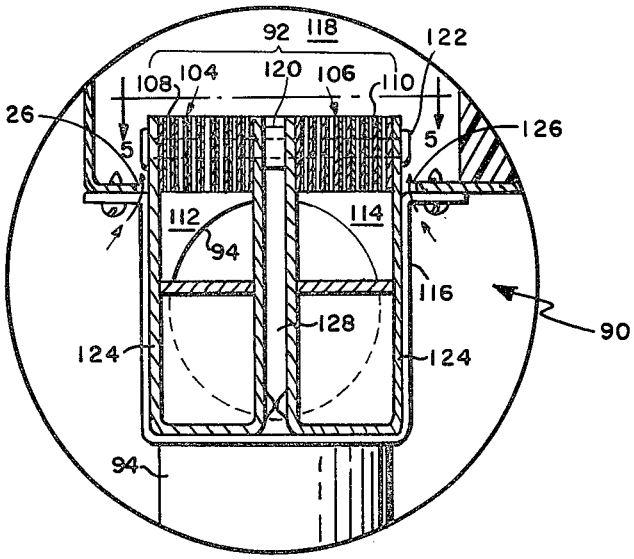
FIG. 4 is an expanded view of the burner portion of FIG. 1 taken along line 4—4 of FIG. 1.

Referring now to FIGS. 1–5 there is shown a combination gas convection and microwave stove 10 embodying the invention. Stove 10 comprises an oven cavity 12 of metal such as porcelainized steel which is closed by a door 14 during operation.

A rack 22 made, for example, of steel rods is supported on bumps 24 formed on the side walls of the enclosure 12 so that the position of the rack 22 may be changed in accordance with well-known oven practice.

The upper portions of the back wall of cavity 12 has an elongated vapor inlet region 16 and the middle of the back wall has a pair of vapor outlet regions 18. Vapor is drawn out of the enclosure 12 through regions 18 into a plenum 20. Regions 16 and 18 preferably have a plurality of apertures 34 whose maximum dimensions are substantially less than a half wavelength of the free space wavelength of the microwave energy radiated into cavity 12. Preferably apertures 34 having maximum dimensions of, for example, less than a tenth of the free space wavelength of the microwave energy radiated into oven 12 by a radiator 26 so that microwave energy radiated into enclosure 12 will not escape through regions 16 or 18.

Radiator 26, which is positioned below rack 22, is a rotatable microwave energy radiator which directs microwave energy up through the apertures in rack 22, through a support plate 28, positioned in the middle of rack 22, and through a dish 30 containing a food body 32 such as a roast of meat. Dish 30, as well as plate 28, is preferably substantially transparent to microwave energy so that the lower region of food body 32 and the interior portions thereof may be heated effectively by microwave energy.

Radiator 26 may comprise, for example, a plenum 36 whose upper surface 38 contains a plurality of apertures 40 through which microwave energy is radiated upwardly into oven 12. A central conductor 42 of a coaxial line 44 supports plenum 36 by being attached to the center of upper plate 38. Conductor 42 extends downwardly through the outer conductor 46 of coaxial line 44 and through a waveguide 48 to a microwave choke and bearing assembly 50. An extension of conductor 42 is rotated by a motor 52 below waveguide 48. Microwave energy from a magnetron 54 is fed through waveguide 48 and coaxial line 44 to radiator 26. A blower 56 blows air past the fins 58 of magnetron 54 to cool the magnetron, but none of this air passes through waveguide 48.

A cover 60 of microwave transparent material is supported over radiator 26 on centering bumps 62 on the bottom of oven 12 to cover radiator 26 and thereby prevent food juices or other material from being dropped on radiator 26.

Door 14 is preferably sealed to enclosure 12 by a high temperature vapor seal with a microwave choke structure positioned between said vapor seal and the interior of enclosure 12 so that microwave energy radiated into oven 12 is largely prevented from being absorbed from the high temperature vapor seal. However, any microwave energy passing through said choke section is substantially absorbed by the high temperature vapor seal. When door 14 is closed, a latch is mechanically moved to lock door 14 shut and to permit energization of the magnetron 54. Further details and advantages of such a microwave oven feed and directive energy rotating structure are disclosed in greater detail in the aforesaid copending application. However, any desired microwave feed structure, radiator, and/or door seal could be used.

In accordance with this invention a slight negative pressure is produced within plenum 20 by a blower system comprising two centrifugal blowers 64 which draw vapor out of cavity 12 through apertures 34 into plenum 20 and blow it out into plenums 66 surrounding blowers 64 and supplying region 16. The upper ends of plenum 66 are connected to an opening through which a small portion of the output of blowers 64 pass through an outlet vent 68 where the air is mixed with the air blown by a second set of blowers 70. Blowers 70 draw cool air in from the back of the stove 10 to cool motors 72 driving blowers 64 and 70 and to supply air to mix with the output of duct 68 which then exits through a screened aperture 74 at the top of the stove 10 above the cooking surface.

As shown in FIGS. 1 and 2, each of the apertured regions 18 supplies vapors from the oven to a separate blower 64, and each blower 64 is driven along with one of the blowers 70, by a separate motor 72 which is supported from a back wall 78 of the stove 10. A partition 80 between the two blowers 64 prevents tangential interaction of the vapor output of the blowers 64. Blowers 64 preferably rotate in opposite directions to cause the air between the blowers to move upwardly adjacent partition 80. It should be clearly understood that a single blower could be used in place of the dual blowers 64 and the plenum 66 could have separate ducting systems to direct the vapor through a plurality of regions 16 into the oven. However, it has been found that the dual counter rotating blower system can improve the uniformity of convection heating in the oven.

A burner system 90 is positioned at the rear of stove 10 behind and below enclosure 12. Burner system 90 comprises a ribbon burner 92 extending across a major portion of the width of the oven and fed at one end with a primary fuel-air mixture through vertical tubular member 94. The open lower end of member 94 is supplied with gas through a gas jet 96 from a solenoid operated valve 98 fed from a pressure regulator through a gas line 102.

Figure 5:
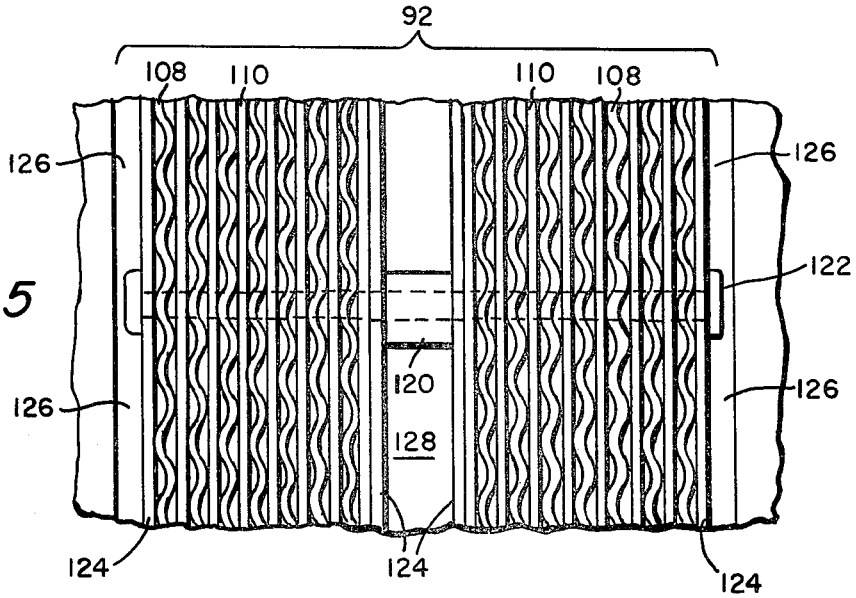
FIG. 5 is an expanded view of a burner portion of FIG. 4 taken along line 5—5 of FIG. 4.

As shown in FIG. 5, the ribbon burner 92 comprises two sections 104 and 106 each formed of seven ribbons of sheet metal 108 approximately one-half inch wide and forty thousandths of an inck thick extending the length of the burner, said members 108 being corrugated, for example, by a die. The corrugations run across the width of the members and are, for example, three sixteenths of an inch from peak to peak. Interspersed between members 108 are flat members 110 of the same width and extending the lengths of the burner so that the spaces between the corregations act as ports through which a primary fuel-air mixture supplied by pipe 94 can flow. The sections 104 and 106 are supplied from separate plenums 112 and 114 respectively which are both supplied at their ends from the pipe 94.

The plenums 112 and 114 are made in the shape of rectangular boxes 124 which are supported by bracket members 116 from the bottom of a combustion plenum 118 communicating with the input to the blowers 64 through plenum 20. The two sections 104 and 106 of the burner are separated by spacers 120 and the burner assembly sections 104 and 106 are held together by rivets 122 extending through the spacers 120 and through all of the ribbon members 108 and 110 and walls of boxes 124, as well as spacers 120 to provide an air space between boxes 124 through which secondary air is drawn into the combustion plenum 118. In addition, secondary burner air is drawn by the outer edges of the burner sections 104 and 106 through spacers 126. As a result, none of the burner ports are spaced from a source of secondary air by more than three intervening ports.

This invention discloses the discovery that by positioning the secondary air close to the ports and by utilizing excess air such as 100% excess air, the flame height may be made less than the total width of the burner section when sufficient fuel-air mixture is drawn through the ports to cause the flame to lift off the ports by a distance of, for example, a sixteenth of an inch to an eighth of an inch. This flame lifting reduces the heating of the port metal ribbons so that flashback ignition of the primary fuel-air mixture in the plenums 112 and 114 is prevented even when a relatively high primary fuel-air mixture is used. By thus reducing the length of the flame, the combustion plenum may be positioned across the lower rear corner of the oven immediately below the outlet regions 18 of the oven and the vapor drawn from the oven throughout outlets 18 will still be substantially deionized so that the microwave screens produced by the apertures 34 remains effective to prevent leakage of microwave energy from the enclosure 12 into the plenum 20 even when both the microwave source and the burner are energized.

In accordance with this invention a safety control circuit is provided in which an air flow sensor 148, comprising a vane actuated switch, is positioned in the output of blowers 70. A manual selector control switch 168 energizes blower motors 72 when one of the convection cooking modes, which may include microwave heating is selected. The blower output closes air sensor switch 148 to energize a conventional resistance heater ignitor 132 extending into plenum 118. After a time delay period of, for example, thirty seconds, solenoid valve 98 is energized to allow gas to be supplied to jet 96. When the resultant fuel-air mixture reaches combustion plenum 118 through the ports in burner 92 it is ignited by the ignitor 132 and the products of combustion are drawn into the blower 64 and blown into the enclosure 12 through the inlet 16. A portion of the output of blower 64 is blown out vent 74 to create a slight negative pressure in combustion chamber 118 and in enclosure 12 to control the amounts of primary air drawn in through the pipe 94 and secondary air drawn in around the edges of the burner sections 104 and 106. Since the tube 94 acts as an air restricting orifice for the primary fuel-air mixture, variations in blower speed and vapor temperature which vary the primary and secondary air drawn into the plenum also cause some variations in the flow of gaseous fuel through the regulator reducing the possibility of an over-rich fuel-air mixture being burned to cause noxious fumes to emanate from the screen 74 at the top of the stove. The burner as shown herein can, for example, operate a thermal output of 20–30 thousand BTU's per hour. The thermal output is selected by selecting the sizes of the pipe 94, and jet 96 as well as the setting of the fuel pressure regulator. The secondary air is selected by selecting the size of the space between boxes 124 and the spaces at the edges of the burner sections 104 and 106 through which secondary air is drawn into the combustion plenum 118.

The foregoing described burner is preferably positioned in the lower rear portion of the stove 10 due to the discovery that if the outlet regions 18 are positioned less than a diameter of the individual blowers 64 from their inputs, then the burner system 90 comprising the ribbon burner 92 may be positioned just below the outlet regions 18 and any residual ionized portions of the combustion products will be drawn directly into the blower rather than eddying into the regions of the apertures 34. Thus, the burner system may be positioned in the same general region as the vapor outlet and blower system thereby freeing up substantially the entire bottom of the oven enclosure for the installation of a rotating microwave radiator and transparent dome therefor.

Since the enclosure vapor outlet region 18 is preferably positioned above the top of the microwave transparent cover 60, it is not necessary to cool cover 60 by blowing air into the oven through the radiator 26 even when vapor having a temperature approaching 1,000° F. is blown into the oven through the region 16 adjacent the top of enclosure 10 during self-cleaning since the vapor will be cool substantially prior to reaching the cover 60. Thus, the cover 60 may be made of conventional cookware materials such as Corningware.

In accordance with this invention there is provided a temperature probe 150, which may be inserted in food body 32, and which is connected by means of an electric cord 152 to a jack 154 in the wall of enclosure 12 so that it may be removed therefrom. A temperature indicator 156 is provided in the top panel of the stove 10 to indicate the temperature sensed by probe 150. The temperature may, for example, be determined by setting a pointer 158 of indicator 156 to the desired food body temperature. When the probe 150 is inserted in the food body and reaches the set temperature, a light 160 will light or an audible alarm will ring. Alternatively, temperature probe 150 can be used to control the application of microwave power to the oven with microwave power being applied whenever the food body temperature sensed by probe 150 is below the temperature set by the pointer 158 and being turned off when the temperature is exceeded. Microwave power may be started at a preselected time which may be set by a knob 162 and the duration of the application of microwave power may be determined by the setting of a timer knob 164. The average microwave power level may be set by a knob 166 to vary the average microwave power supplied to the oven, for example, from 100 to 700 watts.

The gas burner 92 may be controlled by turning a control selector knob 168 to a section marked convection heating and by setting a temperature control knob 170 to a convection vapor temperature. A timer such as, for example, a digital clock 172, may also have on and off selector controls 174 and 176 for setting the time during which convection heat is supplied to the oven.

In operation, a temperature sensor bulb 178, mounted on a bracket in the enclosure 12 directly beneath inlet region 16, senses the temperature of the vapor circulated in the enclosure 12 and when the vapor is below the temperature set by control knob 170, the burner system 90 is energized. As a result, applicants have provided a convection oven in which microwave energy may be used to defrost a food body or to rapidly bring the food body up to temperature while convection heat is used to provide the predominant amount of heat for finishing the heating and/or cooking of the food body as well as for controlling the surface texture and color thereof. Any desired combination of temperatures may be set by the separate control systems so that a wide variety of sizes, shapes, and types of food bodies may be heated with optimum program cycles to provide improved taste and speed of food preparation.

Browning of a food body such as a roast can be controlled by blowing hot vapor through inlet region 16 while radiating full power microwave energy into the oven. The velocity of hot air dries moisture from the surface of the food body so that microwave energy is more readily absorbed by the dry food body surface to brown the food body surface. Therefore, an added broiler or browning unit is not necessary.

An example of power levels for effective food body browning may be microwave energy applied at a rate of 500–800 watts or around 2,000–3,000 BTU's per hour and a gas burner heating rate of about 5,000–15000 BTU's per hour. Such power levels will bake and/or brown a cake in a few minutes.

This completes the description of the preferred embodiments of the invention. Although preferred embodiments have been described, it is believed that numerous modifications and alterations thereto would be apparent to one having ordinary skill in the art without departing from the spirit and scope of the invention. For example, the oven may be fed through apertures located in regions other than the back wall, other electrical control systems and systems for supplying microwave energy to the oven may be used, and other types of circulating systems and burners may be used. Accordingly, it is intended that this invention be not limited to the particular details of the embodiment illustrated herein except as defined by the appended claims.

What is claimed is:

1. A combination microwave and convection heating system comprising:

an enclosure supplied with microwave energy;

a vapor outlet region in the rear of said enclosure comprising a plurality of apertures whose maximum dimensions are substantially less than a half wavelength of said microwave energy;

a blower system positioned outside said enclosure and adjacent said vapor outlet region;

an elongated gas ribbon burner having a plurality of substantially parallel ribbons defining rows of ports, said burner being positioned outside said enclosure beneath said outlet region, said burner having a fuel-air mixture drawn therethrough by said blower system for providing a flow of combustion products past said outlet region to said blower system for circulating said combustion products through said enclosure; and said burner comprising means for restricting the height of the combustion region above said burner to retard ionization of vapor in said vapor outlet region, said restricting means comprising a longitudinal secondary air source dividing said burner into two substantially parallel sections.

2. The combination microwave and convection oven in accordance with claim 1 wherein each of said ports is separated from a source of said secondary air by less than three intervening ports in a direction perpendicular to said rows.

* * * * *